US011353224B2

(12) United States Patent
Hess et al.

(10) Patent No.: US 11,353,224 B2
(45) Date of Patent: Jun. 7, 2022

(54) ROOFTOP EXHAUST SYSTEM WITH AUTOMATIC MOTOR LOCKOUT

(71) Applicant: Captive-Aire Systems, Inc., Raleigh, NC (US)

(72) Inventors: Joshua J. Hess, Washington Boro, PA (US); Nicholas I. Perry, Warrington, PA (US); William Brian Griffin, Columbia, PA (US)

(73) Assignee: Captive-Aire Systems, Inc., Raleigh, NC (US)

( * ) Notice: Subject to any disclaimer, the term of this patent is extended or adjusted under 35 U.S.C. 154(b) by 386 days.

(21) Appl. No.: 16/696,054

(22) Filed: Nov. 26, 2019

(65) Prior Publication Data

US 2021/0156580 A1 May 27, 2021

(51) Int. Cl.

| | |
|---|---|
| ***F24F 11/00*** | (2018.01) |
| ***F24F 7/02*** | (2006.01) |
| ***F24F 140/00*** | (2018.01) |

(52) U.S. Cl.

CPC ..... *F24F 11/0001* (2013.01); *F24F 7/02* (2013.01); *F24F 2140/00* (2018.01)

(58) Field of Classification Search

CPC ..... F24F 11/0001; F24F 7/02; F24F 7/025; F24F 2140/00; F24F 2013/205; F24F 2013/207; F24F 11/88; F24F 11/89; F24F 13/20; F24F 2221/16; F24F 2221/22

USPC ..... 454/343

See application file for complete search history.

(56) References Cited

U.S. PATENT DOCUMENTS

| | | | | |
|---|---|---|---|---|
| 4,633,769 | A | 1/1987 | Milks | |
| 4,977,884 | A * | 12/1990 | Kaufman | F04D 25/08 126/299 D |
| 5,816,909 | A * | 10/1998 | Wunder | F24F 7/025 454/341 |
| 6,289,555 | B1 * | 9/2001 | Nguyen | F24F 7/025 16/235 |
| 2016/0252263 | A1 * | 9/2016 | Chwala | F24F 7/025 454/354 |
| 2017/0082318 | A1 * | 3/2017 | Glenn | F24F 7/025 |

FOREIGN PATENT DOCUMENTS

| | | | |
|---|---|---|---|
| AU | 2008200681 | A1 | 3/2009 |

* cited by examiner

*Primary Examiner* — Steven B McAllister
*Assistant Examiner* — Charles R Brawner
(74) *Attorney, Agent, or Firm* — Coats & Bennett, PLLC

(57) ABSTRACT

A rooftop exhaust fan incorporates a mechanical motor lockout that prevents a fan motor from being energized when the exhaust fan assumes an open position for cleaning, maintenance or inspection.

8 Claims, 2 Drawing Sheets

ROOFTOP EXHAUST SYSTEM WITH AUTOMATIC MOTOR LOCKOUT

FIELD OF THE INVENTION

The present invention relates to rooftop ventilation systems.

BACKGROUND

Rooftop exhaust systems are employed in a wide variety of applications. Various types of rooftop exhaust systems are used in general ventilation applications to exhaust air from a building. They are also employed on rooftop commercial kitchens to exhaust smoky and grease-laden air that is exhausted through a kitchen hood. These ventilation systems typically include an electric motor and a fan driven by the electric motor. From time-to-time, these ventilation systems must be cleaned, maintained and even inspected by regulatory officials. This means they must be open in order to gain access to the motor, fan and the surrounding interior. When exhaust systems assume the open configuration for cleaning and maintenance, personnel performing these tasks must be careful to make sure that the motor is disconnected from its source of power.

Therefore, there has been and continues to be a need for a simple and reliable motor lockout that can be incorporated into a rooftop exhaust fan to assure that the motor is disconnected from its power source when the exhaust fan is open for cleaning, maintenance or inspection.

SUMMARY OF THE INVENTION

A rooftop exhaust system includes a motor and a fan contained within a housing that is pivotally mounted to a support and moveable between a closed position and an inclined open position. A disconnect switch for disconnecting the motor from its power source is secured to the housing and moveable therewith as the housing pivots between the closed and open positions. A mechanical lockout is provided. The mechanical lockout is configured to automatically switch the disconnect switch off in response to the housing moving from the closed position to the open position. In addition, the mechanical lockout is configured to prevent the disconnect switch from moving from the off position to the on position while the exhaust fan assumes the open position.

The present invention also discloses a method of locking out the exhaust fan motor. In one embodiment, the lockout is stationarily mounted adjacent the housing of the exhaust fan and aligned with the disconnect switch carried by the housing. As the housing is rotated from the closed position to the open position, the disconnect switch engages the lockout and as the housing continues to be rotated, the lockout moves the disconnect switch from an on position to an off position.

The disconnect switch mounted on the housing of the exhaust fan moves through a travel path as it moves from an off position to an on position. When the housing is inclined in the open position, the lockout lies in this travel path and prevents the disconnect switch from being inadvertently moved from the off position to the on position.

Other objects and advantages of the present invention will become apparent and obvious from a study of the following description and the accompanying drawings which are merely illustrative of such invention.

DESCRIPTION OF EXEMPLARY EMBODIMENTS

Figure 1:
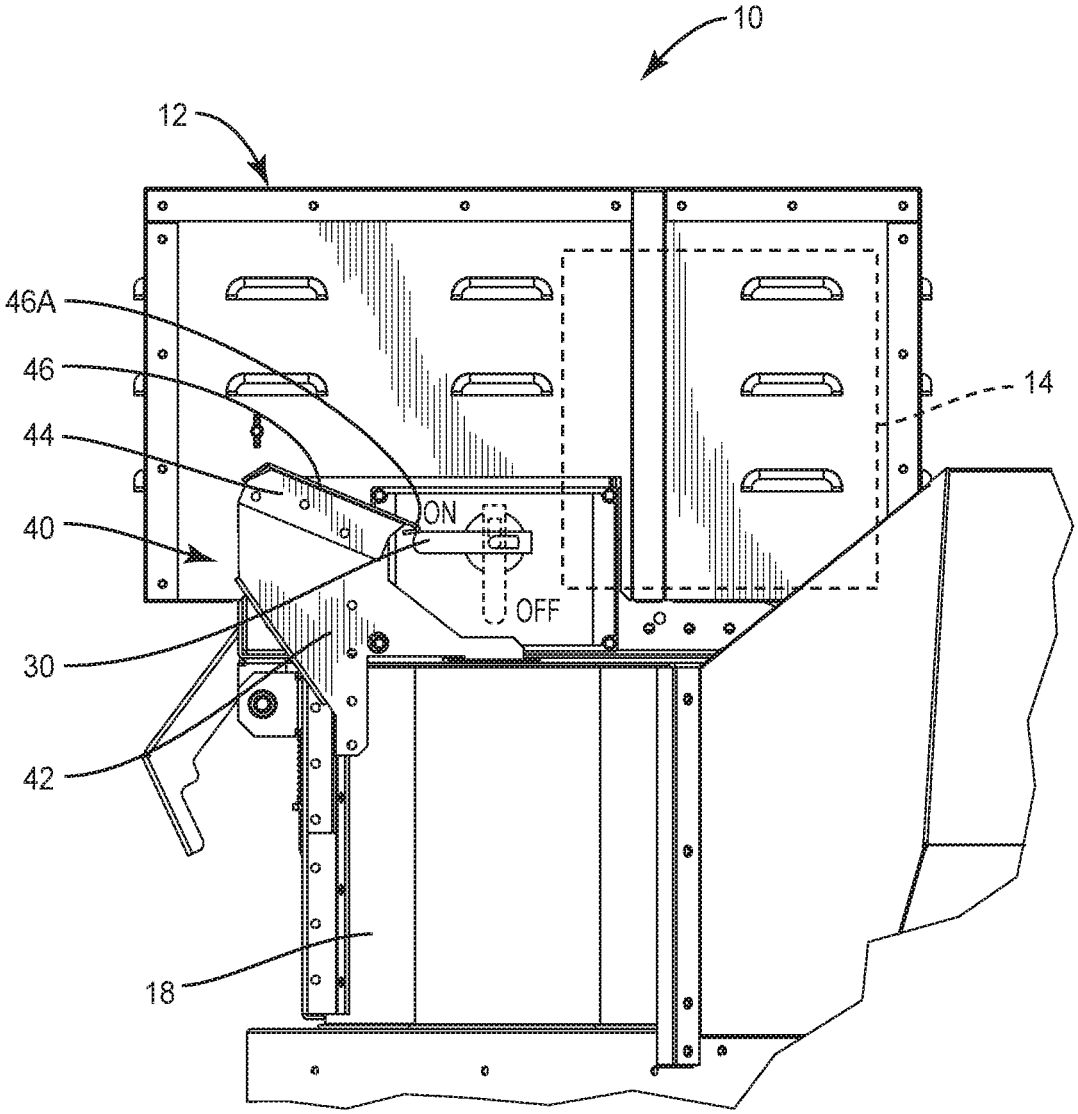
FIG. 1 is a side elevational view of a rooftop exhaust fan shown in the closed position with respect to an underlying support structure.

With further reference to the drawings, an exhaust fan assembly is shown therein and indicated generally by the numeral 10. In the example shown, the exhaust fan is what is generally referred to as an upblast type. It is understood and appreciated by those skilled in the art that the present invention can be employed with a downblast type exhaust fan. As discussed earlier, the exhaust fan 10 can be used for general ventilation or can be used in conjunction with a commercial kitchen to exhaust smoky and grease-laden air that emanates from a cooking surface generally disposed underneath the hood.

Viewing the exhaust fan in more detail, it is seen that the same includes a housing 12. Designs for the housing can vary. In this particular case, housing 12 is a box-type housing having a plurality of vents formed in the side wall. Housing 12 includes an internal frame structure for supporting an electric motor 14 and a fan 16. Fan 16, illustrated in the drawings, is what is referred to as a fan wheel. But it is understood and appreciated by those skilled in the art that various types of fans, such as a propeller-type, could be employed as a part of the exhaust fan 10. Motor 14 lies above the fan 16 and in the embodiment illustrated herein is directly coupled to the fan for driving the same. People skilled in the art will appreciate that other driving arrangements can be provided without departing from the present invention.

Housing 12 is pivotally mounted to an underlying support 18. The design and structure of the support 18 can vary. In the embodiment illustrated, support 18 forms a duct through which exhaust air passes. In some embodiments, the support 18 is operatively connected to an internal duct structure disposed in a building or commercial kitchen.

Figure 2:
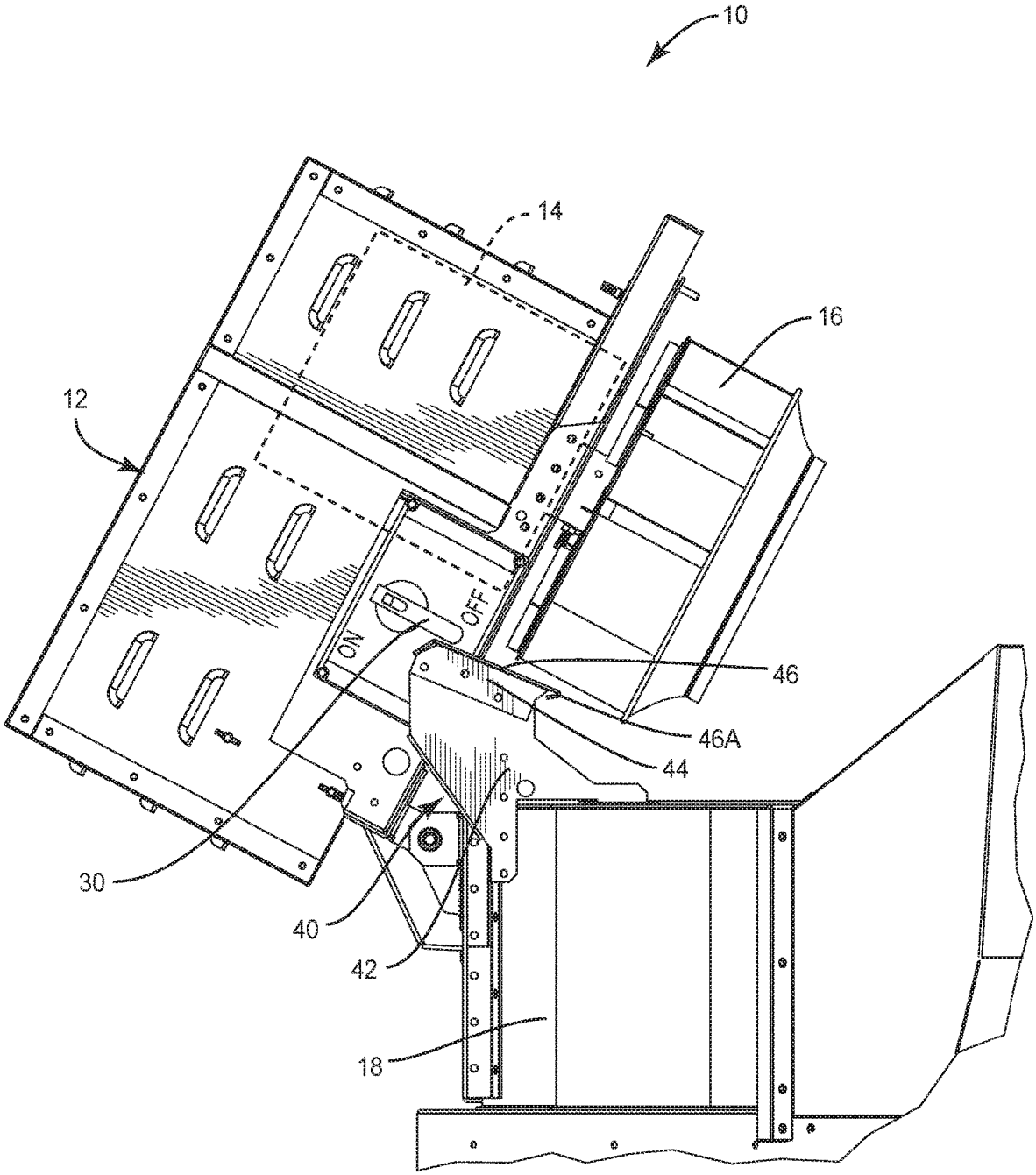
FIG. 2 is a side elevational view of the exhaust fan showing the housing thereof pivoted to an inclined open position to permit access to a fan and motor supported by the housing.

As noted above, housing 12, containing the motor 14 and fan 16, is pivotally mounted to the support 18 and moveable between a closed position (FIG. 1) and an inclined open position (FIG. 2). Housing 12 is normally disposed in the closed position. When in the closed position, housing 12 effectively connects to the underlying support 18 such that air being induced upwardly through the support, passes into the housing 12 after which it is exhausted to the atmosphere. In the closed position, the axis of the motor 14 and fan 16 is disposed in a vertical orientation. Thus, it is appreciated that during the ordinary course of use, exhaust air is induced upwardly past the fan 16 and around the motor 14 after which it is exhausted from the housing 12.

As seen in FIG. 2, when the housing 12 is disposed in the inclined open position, the fan 16 projects downwardly from the bottom of the housing 12 and is exposed for cleaning or maintenance. When the housing 12 is in the open position, the motor 14 and the interior of the housing are also exposed, enabling cleaning.

Electric motor 14 is connected to an electric power source in a conventional manner. There are various ways appreciated by those skilled in the art to actuate and control the electric motor 14. In some cases, the control of the motor 14 may be as simple as sensing the temperature of the air in a particular area of a building or in some cases, the motor may be controlled by a programmable controller that takes into account various factors in actuating and de-actuating the motor 14.

Exhaust fan 10 is provided with an automatic motor lockout system for locking out the motor 14 when the housing assumes the open position (FIG. 2). Forming a part of this system is a disconnect switch 30. Disconnect switch 30 is mounted to one side of the housing 12 and is exposed. Disconnect switch 30 is operatively connected to the electric motor 14 or at least to the source of electric power to the motor. In any event, the disconnect switch 30 in this particular embodiment includes a lever arm that is moveable back and forth between an "on" position and an "off" position. As viewed in FIG. 1, when the lever arm is disposed in the vertical position, the disconnect switch is "off". When the lever arm is disposed in the horizontal position, the switch is "on" and does not interfere with energizing the motor 14. Therefore, in a normal mode of operation where the exhaust fan is exhausting air from a building or commercial kitchen, the disconnect switch 30 is on, which enables power to reach and energize the motor 14.

It is important to appreciate that when the housing is in the open position and the fan 16 is exposed as shown in FIG. 2, it is important to assure that the lever arm of the disconnect switch 30 is "off". Care must be taken to assure that it is not inadvertently moved to the "on" position when personnel are cleaning, maintaining or inspecting the exhaust fan.

Exhaust fan 10 is provided with a mechanical lockout indicated generally by the numeral 40. The purpose of the mechanical lockout 40 is to assure that in all cases the disconnect switch 30 is in the "off" position when the housing 12 is disposed in the open position. Viewing the mechanical lockout in more detail, it is seen that the same includes a lockout support 42 that is secured to the underlying support 18 and projects upwardly therefrom. A flange 44 is secured to the lockout support 42 and an upper edge thereof is turned to form a ramp 46. At one end of the ramp, there is a terminal edge 46A. See FIG. 1.

Mechanical lockout 40 is particularly positioned with respect to the disconnect switch 30. Mechanical lockout 40 is stationary and does not move with the housing 12. Housing 12 moves with respect to the mechanical lockout 40.

Note the orientation of the mechanical lockout 40 when the housing 12 is disposed in the closed position as shown in FIG. 1. Assume that the lever arm of the disconnect switch 30 is in the horizontal or "on" position. Note that the terminal edge 46A of the ramp 46 is engaging or is in close proximity to the outer terminal end of the switch lever arm.

Assume that the housing 12 is to be moved from the closed position to the inclined open position for cleaning or maintenance. As the housing 12 rotates counterclockwise, as viewed in the FIG. 1, the terminal edge 46A of the mechanical lockout 40 engages the switch lever arm and begins to push the switch lever arm towards the "off" position. As the housing 12 is continued to be rotated, it is seen that the terminal end of the switch lever arm engages the ramp 46 and is continued to be rotated to the "off" position.

FIG. 2 shows the housing 12 in the inclined open position. Now the switch lever arm assumes the "off" position. Equally important is the location or position of the ramp 46 with respect to the switch lever arm. Note that the switch lever arm cannot move from the "off" position to the "on" position. This is because the ramp 46 of the mechanical lockout 40 lies in the path that is normally traveled as the lever arm moves from the "off" position to the "on" position. Thus, the ramp 46 effectively forms a stop that prevents the lever arm from moving from the "off" position to the "on" position. This assures that the disconnect switch cannot be inadvertently moved to the on position when the housing is in the open position.

From the foregoing specification and discussion, it is appreciated that the present invention has the advantage of being a simple and reliable mechanical lockout for preventing the fan 16 from operating when the housing 12 is disposed in the open position. Indeed, the design of the mechanical lockout 40 is such that the mechanical lockout will automatically move the switch arm from the on position to the off position as the housing 12 is rotated from the closed position to the open position.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A rooftop exhaust system for exhausting air form a building, comprising:

a housing including one or more sides;

a motor mounted in the housing;

a fan rotatively mounted in the housing and driven by the motor;

a support disposed underneath the housing for supporting the housing;

the housing having the motor and fan pivotally connected to the support and moveable between a closed position where exhaust air moves upwardly through the support and through the housing and an open position where the housing is tilted with respect to the support and access can be gained to the fan and motor;

a motor disconnect switch mounted on the side of the housing and moveable back and forth from an on position to an off position;

the motor disconnect switch being operatively connected to the motor or to a source of electricity for the motor and configured to prevent the motor from being energized when the motor disconnect switch is in the off position; and a stationary motor lockout mounted adjacent to and aligned with the motor disconnect switch and configured to:

(a) engage the motor disconnect switch when the motor disconnect switch is in the on position and to move the motor disconnect switch to the off position in response to the housing pivoting from the closed position to the open position, and (b) lie in the path of the motor disconnect switch when the housing assumes the open position, preventing the motor disconnect switch from moving from the off position to the on position.

2. The rooftop exhaust system of claim 1 wherein when the housing is in the closed position and the motor disconnect switch is in the on position, the stationary motor lockout engages the motor disconnect switch or terminates in close proximity thereto; and wherein when the housing assumes the open position and the motor disconnect switch assumes the off position, the stationary motor lockout either engages the motor disconnect switch or lies closely adjacent thereto and is positioned to prevent the motor disconnect switch from being moved from the off position to the on position.

3. The rooftop exhaust system of claim 1 wherein the stationary motor lockout comprises a fixed ramp that includes a terminal end, with the ramp and terminal end thereof being aligned with the motor disconnect switch; and wherein in response to the housing moving from the closed position to the open position while the motor disconnect switch assumes the on position, the stationary motor lockout is configured such that the terminal end of the ramp engages the motor disconnect switch and moves the motor disconnect switch towards the off position and thereafter the motor disconnect switch rides along the ramp until it reaches the off position.

4. The rooftop exhaust system of claim 3 wherein the motor disconnect switch comprises an elongated lever arm and when the housing is in the open position, the ramp extends parallel with the lever arm.

5. A method of manipulating a rooftop exhaust system and locking out an electric motor thereof while cleaning or maintenance is performed on the exhaust system, the method comprising;

pivoting a housing of the exhaust system from a closed position to an open position and accessing the motor and a fan mounted in the housing for purposes of cleaning, maintenance or inspection;

locking out the motor of the exhaust system by:

(a) as the housing is being pivoted, engaging a motor disconnect switch disposed on a side of the housing with a stationary motor lockout;

(b) continuing to pivot the housing and as the housing is moved from the closed position to the open position, engaging the motor disconnect switch and moving the motor disconnect switch from an on position to an off position during the course of pivoting the housing from the closed position to the open position; and (c) preventing the motor disconnect switch from moving from the off position to the on position while the housing is disposed in the open position by stationing the stationary motor lockout in the path normally travelled by the motor disconnect switch in moving from the off position to the on position.

6. The method of claim 5 wherein the method includes bodily rotating the motor disconnect switch into contact with the stationary motor lockout as the housing is rotated from a closed position to an open position.

7. The method of claim 5 wherein the housing is pivotally mounted to an underlying support and wherein the stationary motor lockout is fixed to the support and projects upwardly therefrom;

wherein the stationary motor lockout includes a portion that is aligned with the motor disconnect switch and the method includes moving the motor disconnect switch into engagement with the stationary motor lockout.

8. The method of claim 7 wherein when the housing assumes the open position, the stationary motor lockout includes a portion that lies adjacent the motor disconnect switch and forms a stop that prevents the motor disconnect switch from moving from the off position to the on position.

* * * * *